US007000775B2

(12) United States Patent
Gelardi et al.

(10) Patent No.: US 7,000,775 B2
(45) Date of Patent: Feb. 21, 2006

(54) PRODUCT CONTAINER WITH LOCKING END CAP

(75) Inventors: John A. Gelardi, Kennebunkport, ME (US); Richard Mazurek, Huntingdon Valley, PA (US)

(73) Assignee: Westvaco Packaging Group, Inc., New York, NY (US)

( * ) Notice: Subject to any disclaimer, the term of this patent is extended or adjusted under 35 U.S.C. 154(b) by 84 days.

(21) Appl. No.: 10/164,477

(22) Filed: Jun. 6, 2002

(65) Prior Publication Data

US 2003/0226770 A1 Dec. 11, 2003

(51) Int. Cl.
*B65D 25/54* (2006.01)

(52) U.S. Cl. ..... 206/776; 206/485

(58) Field of Classification Search ..... 206/1.5, 206/461, 775, 776, 485; 220/293, 294, 295, 220/298, 300–302; 229/5.5, 125.01, 125.125
See application file for complete search history.

(56) References Cited

U.S. PATENT DOCUMENTS 2,442,979 A * 6/1948 Larson ..... 206/278
2,974,825 A * 3/1961 Ross ..... 229/5.5
2,975,888 A * 3/1961 Paynton, Sr. ..... 206/771
4,051,992 A * 10/1977 Bergstein ..... 229/5.5
4,802,577 A * 2/1989 O'Leary ..... 206/278
5,641,064 A * 6/1997 Goserud ..... 206/315.1
6,230,893 B1 * 5/2001 Karow ..... 206/1.5
6,622,867 B1 * 9/2003 Menceles ..... 206/461

OTHER PUBLICATIONS

Photographs of Lindt & Sprüngli chocolate package, 2000.

* cited by examiner

*Primary Examiner*—Luan K. Bui
(74) *Attorney, Agent, or Firm*—Daniel Kim, Esq.

(57) ABSTRACT

A package is described that includes a sleeve having at least one end defining an opening. The sleeve further includes at least one pair of locking tabs extending therefrom, each locking tab including a locking edge, each locking tab being folded inwards into the opening. The package further includes a rigid end cap dimensioned to fit closely within the opening, the end cap including a rim designed so that, when the end cap is inserted into the opening, the rim engages the sleeve end and prevents the end cap from being inserted further into the opening. The end cap further includes a channel for receiving the pair of locking tabs, the channel having a ledge that engages the locking edge of each locking tab to prevent the end cap from being removed from the sleeve opening. Another described package provides a release mechanism for allowing an end cap to be removed without causing damage to the package.

6 Claims, 24 Drawing Sheets

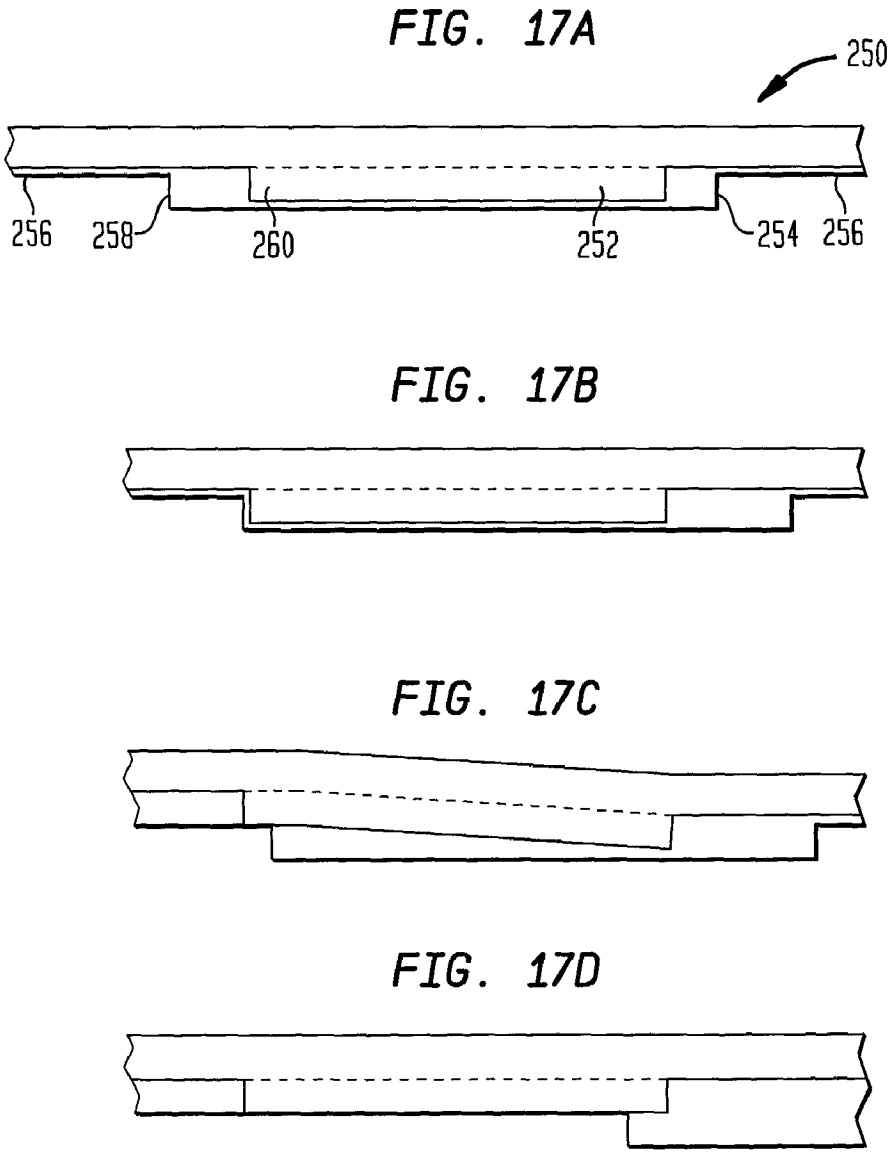
FIG. 17A
FIG. 17B
FIG. 17C
FIG. 17D
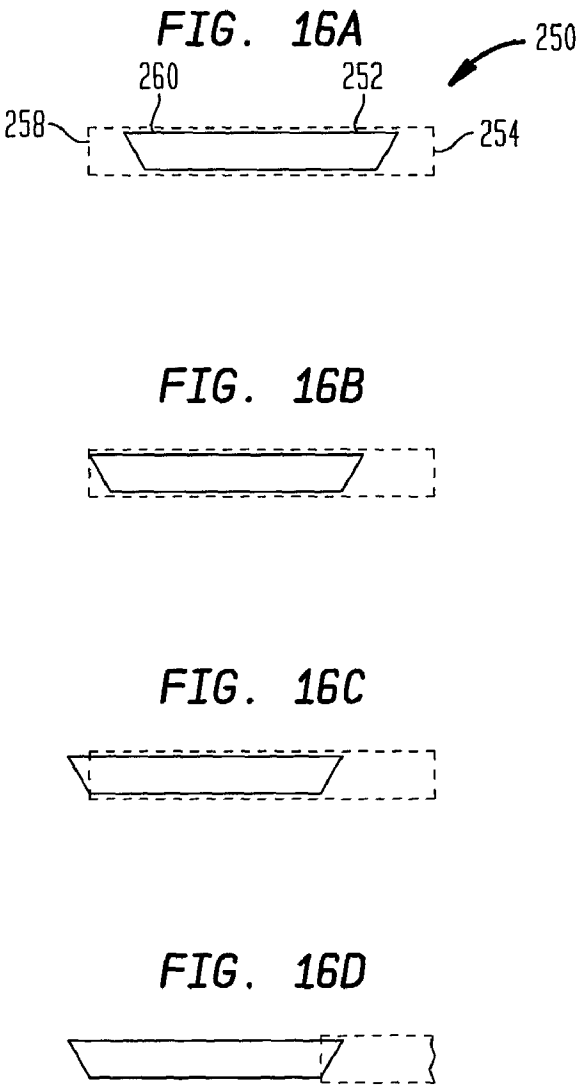
FIG. 16A
FIG. 16B
FIG. 16C
FIG. 16D 270
274
272
276
278

270
274
272

PRODUCT CONTAINER WITH LOCKING END CAP

BACKGROUND OF THE INVENTION

1. Field of the Invention

The present invention relates generally to the field of product packaging, and in particular to product containers having a locking end cap.

2. Description of the Prior Art

Product packaging serves a number of different functions, including: protecting the packaged product from accidental damage, attractively displaying the packaged product, and preventing theft or tampering. In addition, it is desirable for a package to be as inexpensive to manufacture as possible.

There is an ongoing need in the packaging industry for new package designs.

SUMMARY OF THE INVENTION

An aspect of the invention provides a package including a sleeve having at least one end defining an opening. The sleeve further includes at least one pair of locking tabs extending therefrom, each locking tab including a locking edge, each locking tab being folded into the opening. The package further includes a rigid end cap dimensioned to fit closely within the opening, the end cap including a rim designed so that, when the end cap is inserted into the opening, the rim engages the sleeve end and prevents the end cap from being inserted further into the opening. The end cap further includes a channel for receiving the pair of locking tabs, the channel having a ledge that engages the locking edge of each locking tab to prevent the end cap from being removed from the sleeve opening. A further aspect of the invention provides a release mechanism for allowing an end cap to be removed without causing damage to the package.

Additional features and advantages of the present invention will become apparent by reference to the following detailed description and accompanying drawings.

BRIEF DESCRIPTION OF THE DRAWINGS

FIGS. 16A–D and 17A–D are a series of diagrams illustrating the operation of a release mechanism according to an aspect of the invention.

DETAILED DESCRIPTION

An aspect of the invention provides a product container comprising a sleeve that includes at least one end that is closed by inserting an end cap. According to a further aspect of the invention, the end cap may be affixed to the sleeve using a releasable locking mechanism or a non-releasable locking mechanism. As described below, the releasable locking mechanism allows the end cap to be removed using a twisting motion, without damaging the package. Where the non-releasable locking mechanism is used, the end cap cannot be removed from the sleeve without causing visible damage to the sleeve. Depending upon the use for the package, the sleeve may be closed with two non-releasable locking caps, two releasable locking caps, or one non-releasable locking cap and one releasable locking cap.

The use of at least one releasable locking cap may be desirable for a number of reasons. First, when the package is being loaded with product, the use of a releasable end cap allows a packaged item to be reworked without having to discard the package. Also, a customer may find a releasable end cap to be desirable. For example, a releasable end cap would allow the customer quick and easy access to the packaged item. Also, the customer may wish to replace the end cap for storage purposes, or for reusing the package.

Figure 1:
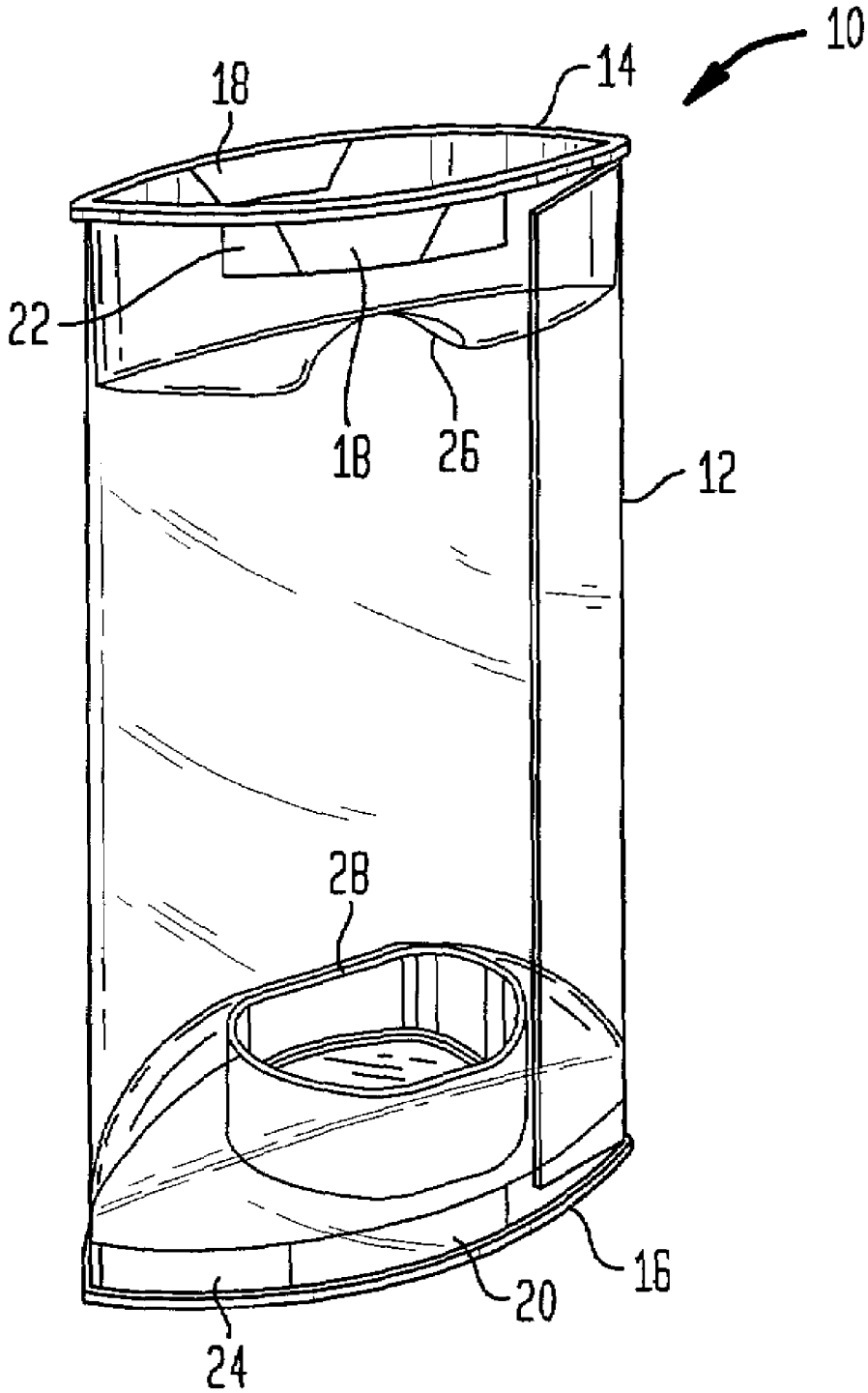
FIG. 1 shows a perspective view of a product package according to an aspect of the invention.

FIG. 1 shows a perspective view of a product package 10 according to a first aspect of the invention. The package 10 includes a sleeve 12 having an upper opening at an upper end and a lower opening at a lower end. The sleeve 12 may suitably be fabricated from a sheet of see-through plastic material, such as PVC, APET, PETG, or the like. The thickness of the sheet is selected based on a number of factors, including price and strength. The sheet should be thick enough to provide structural support, but thin enough to allow the sheet to be flexed and folded, as described herein.

The upper and lower openings of the sleeve 12 are closed by upper and lower end caps 14 and 16. Each end cap 14 and 16 is a rigid body that is shaped to fit closely within its respective opening. As described below, each end cap 14 and 16 is secured in position using a locking mechanism. In the present example, the upper end cap 14 is secured using a releasable locking mechanism, and the lower end cap 16 is secured using a non-releasable locking mechanism.

The sleeve 12 includes an upper pair of locking tabs 18 that are folded inwards into the interior of the sleeve 12 for securing the upper end cap 14, and a lower pair of locking tabs 20 that are folded inwards into the interior of the sleeve 12 for securing the lower end cap 16. As further described below, the upper end cap 14 includes a pair of channels 22 corresponding in position to the pair of upper locking tabs 18. The lower end cap 16 includes a single continuous channel 24 encircling the perimeter of the lower end cap 16.

As described below, different channel arrangements are used to create, respectively, a releasable locking mechanism and a non-releasable locking mechanism. As further described below, the upper end cap 14 is released by twisting the upper end cap 14 within the sleeve 12. The lower end cap 16 is not releasable, and cannot be removed without causing damage to the package 10.

As further shown in FIG. 1, the top and bottom end caps 14 and 16 are provided with molded cavities 26 and 28 that are shaped to receive an item to be held in the package 10. It will be appreciated that cavities 26 and 28 may be freely modified to accommodate differently shaped items.

Figure 2:
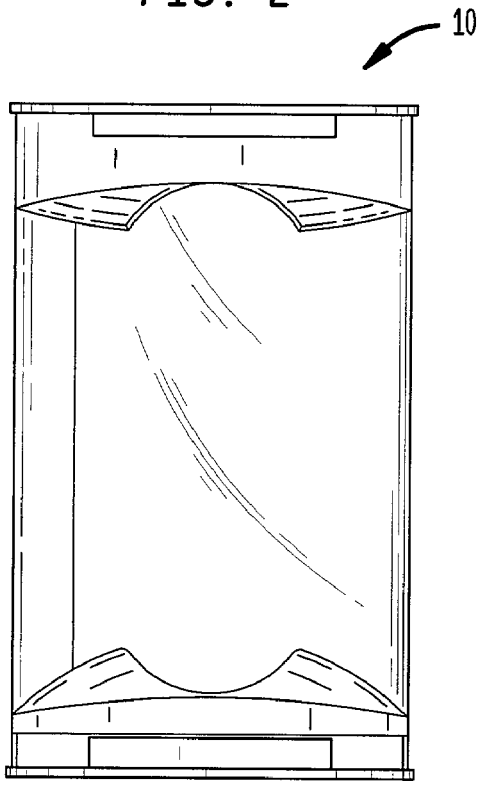
FIGS. 2 and 3 show front and rear views of the package shown in FIG. 1.
Figure 3:
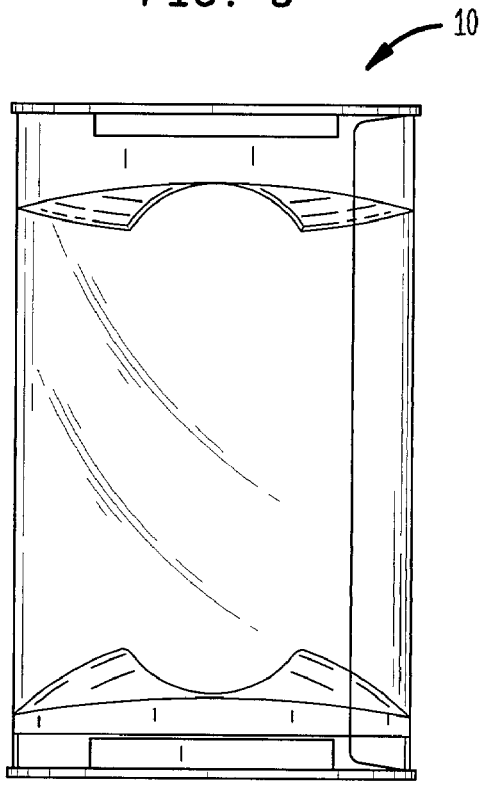
Figure 4:
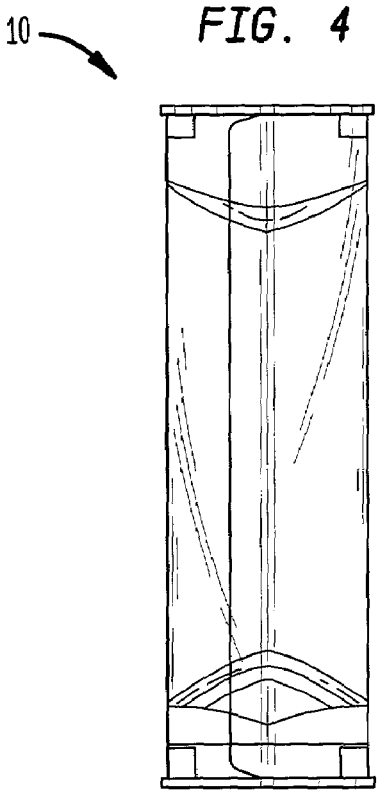
FIGS. 4 and 5 show left and right side views of the package shown in FIG. 1.
Figure 5:
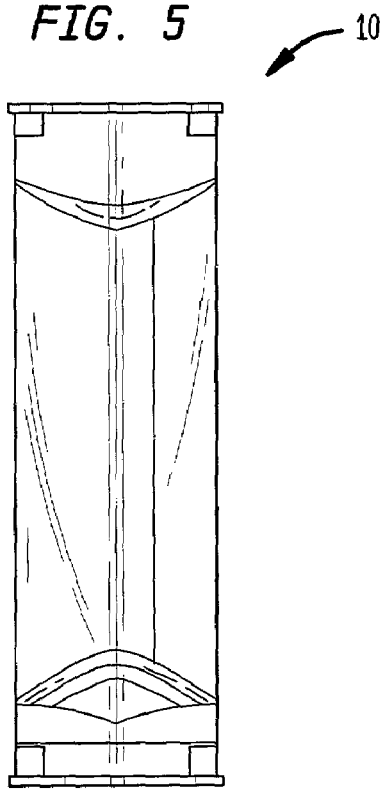
Figure 6:
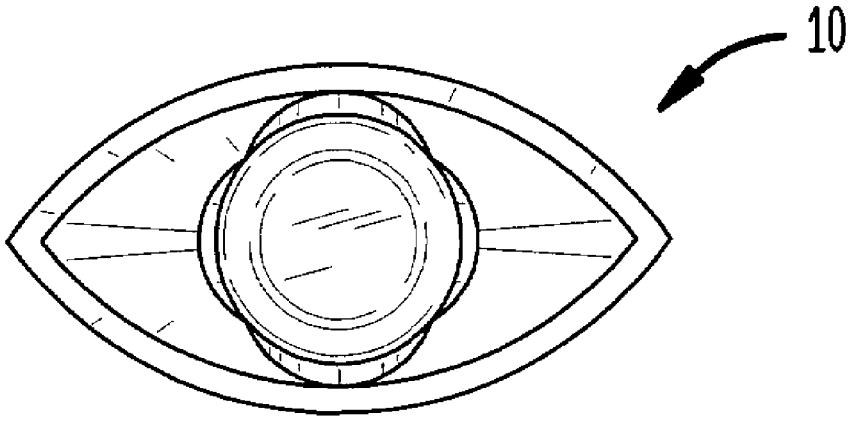
FIGS. 6 and 7 show top and bottom views of the package shown in FIG. 1.
Figure 7:
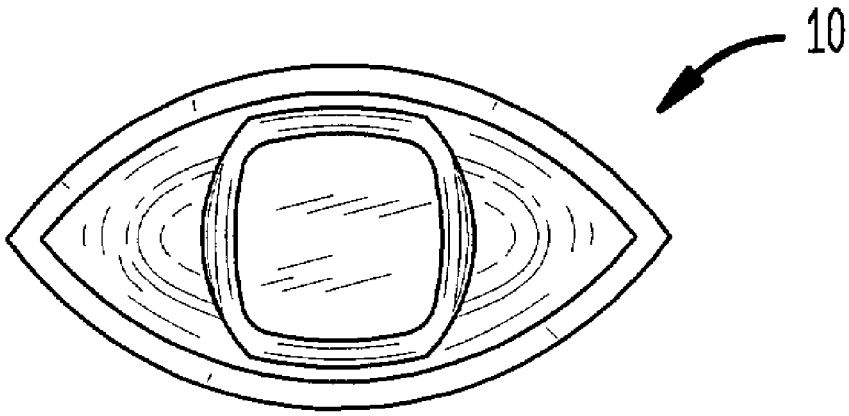

FIGS. 2 through 7 show additional views of the package 10 shown in FIG. 1. FIGS. 2 and 3 show, respectively, front and rear views of the package. FIGS. 4 and 5 show left and right side views of the package 10. FIGS. 6 and 7 show top and bottom views of the package 10.

Figure 8:
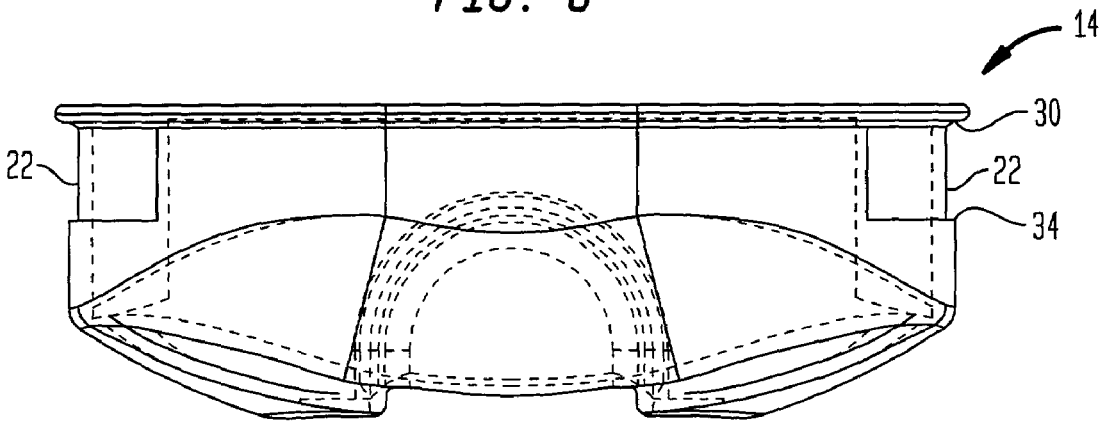
FIGS. 8 and 9 show, respectively, elevation views of an upper and lower end cap according to an aspect of the invention.
Figure 9:
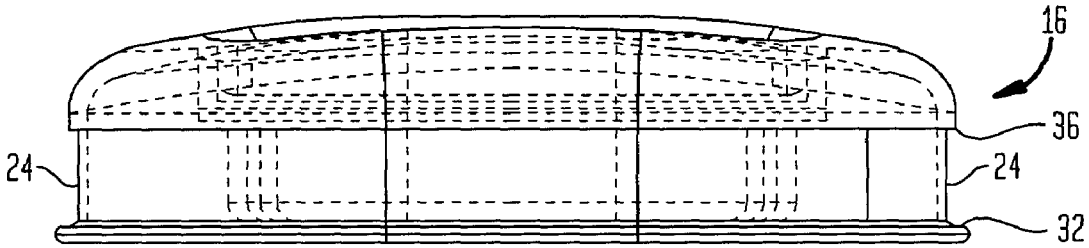

FIGS. 8 and 9 show elevation views of the upper and lower end caps 14 and 16. Each end cap 14 and 16 is a rigid body that may suitably be fabricated, for example, using an injection molding technique. Suitable materials for the end caps include PVC, polypropylene, polyethylene, and polystyrene.

The upper end cap 14 shown in FIG. 8, as mentioned above, provides a releasable locking mechanism for securing the end cap 14 to the sleeve. The releasable locking mechanism includes a pair of rectangular channels 22 on opposite sides of the end cap 14. The pair of channels 22 is positioned to receive a corresponding pair of locking tabs 18 extending from the sleeve 12. The upper side of each channel 22 is defined by a rim 30 that is dimensioned to be slightly larger than the upper opening of the sleeve 12, and to engage the upper sleeve end to prevent the end cap 14 from being inserted too far into the sleeve opening. The lower side of each channel 22 is defined by a ledge 34, which provides a surface for engaging a locking edge of each upper locking tab 18.

The lower end cap 16 shown in FIG. 9 provides a non-releasable locking mechanism for securing the lower end cap 16 in the lower opening of the sleeve 12. The non-releasable locking mechanism includes a single channel 24 encircling the end cap 16. The lower side of the channel 24 is defined by a rim 32 that is dimensioned to be larger than the bottom sleeve opening. The upper side of the channel 24 is defined by a ledge 36 that provides a surface for engaging a locked edge of each lower locking tab 20 extending from the sleeve 12.

Figure 10:
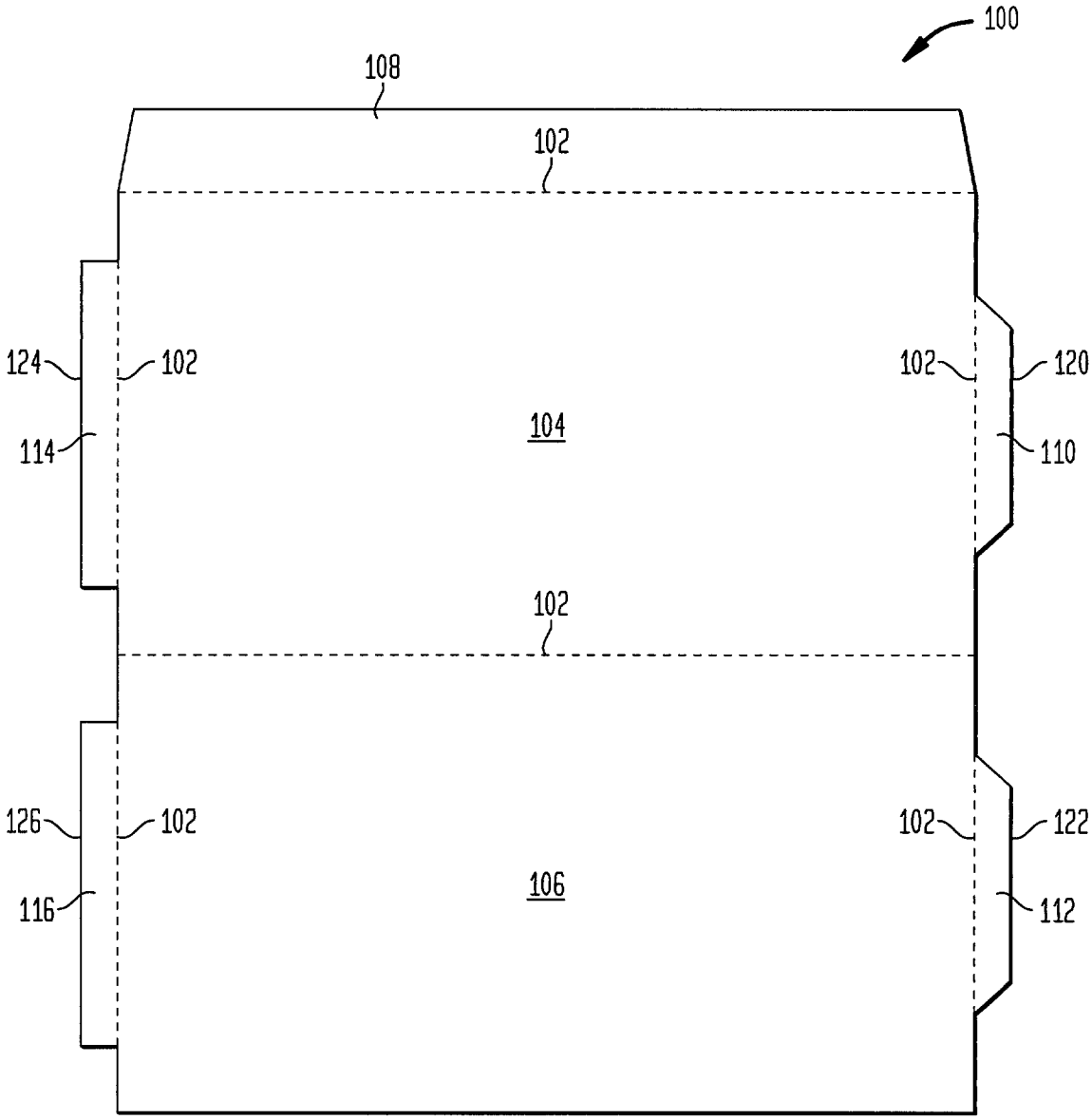
FIG. 10 shows a plan view of a blank for fabricating a sleeve according to an aspect of the invention.

The operation of the locking and release mechanisms is now described with respect to an exemplary container and exemplary fabrication technique. It will be apparent that the described container and fabrication technique may be modified without departing from the spirit of the invention. FIG. 10 shows a plan view of a blank 100 for forming a sleeve according to an aspect of the invention. The blank 100 is die cut from a sheet of suitable material, such as PVC, APET, or PETG. If desired, textual or graphic matter may be printed directly onto the blank using a high-speed printing process.

A series of score lines 102 is fabricated into the blank 100 to divide the blank into a number of panels and tabs. The blank 100 includes a first panel 104 and a second panel 106 that are folded towards each other to form the body of the finished sleeve. A glue flap 108 extends upward from the first panel 102, opposite the second panel 104, and is used to attach the outside edges of the first and second panels 104 and 106 to each other.

Extending from the right side of each of the first and second panels 104 and 106 is a releasable locking tab 110 and 112. According to an aspect of the invention, the releasable locking tabs 110 and 112 are trapezoidal in shape. As discussed below, other shapes may be used for the releasable locking tabs 110 and 112.

Non-releasable locking tabs 114 and 116 extend from the left side of the first and second panels 104 and 106. According to an aspect of the invention, the non-releasable locking tabs 114 and 116 are rectangular in shape. Each of the locking tabs 110 includes a respective locking edge 120, 122, 124 and 126 that, as described below, engages a ledge in an end cap, such as ledge 156 in end cap 150 illustrated in FIGS. 13A–D and described below, to lock the end caps in position in the sleeve ends.

It will be seen that when the second panel 106 is folded over the first panel 104, locking tabs 112 and 116 will line up with locking tabs 110 and 114. However, other orientations for the locking tabs 110, 112, 114 and 116 may also be used without departing from the spirit of the invention.

Figure 11:
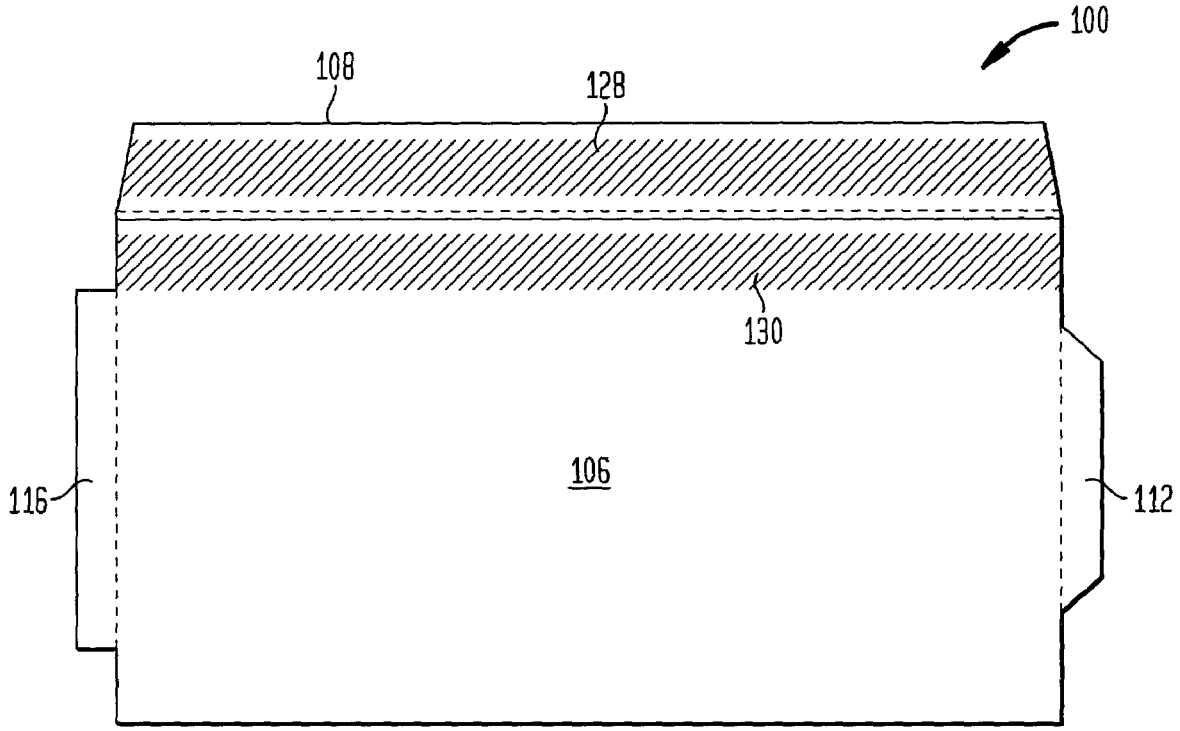
FIG. 11 shows a plan view of the blank shown in FIG. 10, partially fabricated into a sleeve.

In fabricating a finished sleeve from the blank 100, the second panel 106 is folded over the first panel 104. The partially folded blank 100 is shown in FIG. 11. The glue flap 108 is then folded over the second panel 106, and a suitable technique is employed to cause the glue flap 108 to adhere to the second panel 106 at the cross-hatched regions 128 and 130. It will be seen that the bonding of the glue flap 108 to the second panel 106 creates a tube with openings at the left and right of the blank 100.

Figure 12A:
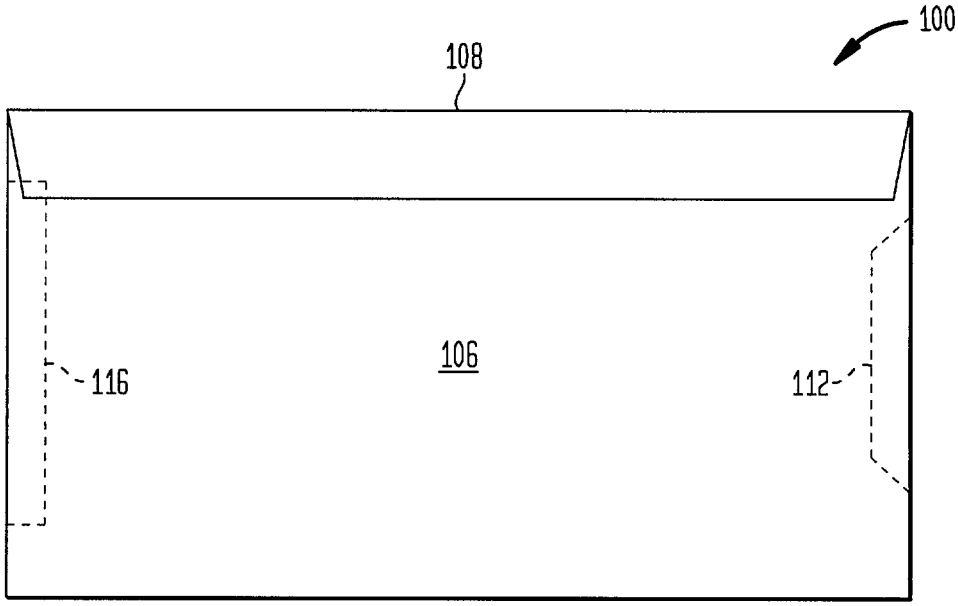
FIG. 12A shows a plan view of the blank shown in FIG. 10, fully assembled into a sleeve.
Figure 12B:
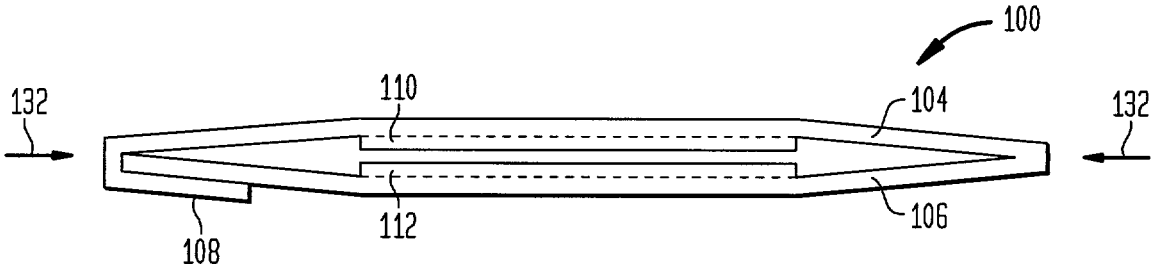
FIG. 12B shows a side view of the blank shown in FIG. 12A.

Prior to the attachment of the end caps, the locking tabs 110, 112, 114 and 116 are folded inward towards the interior of the sleeve. FIG. 12A shows a plan view of the finished sleeve 100, and FIG. 12B, not drawn to scale, shows a right side view of the sleeve 100. The sleeve 100 may be readily popped opened for insertion of the end caps by applying gentle pressure to the sleeve in the direction of the arrows 132 shown in FIG. 12B.

Depending on the dimensions of the finished sleeve 100, it would be possible for a worker to hold the sleeve 100 in one hand, using the thumb and fingers to apply pressure to the side edges of the sleeve 100. The worker could then pop the sleeve 100 open, and use the other hand to install an end cap into one of the two sleeve openings. Once the first end cap has been installed, the package is relatively stable, and can be stood on end, with the installed end cap acting as a base. Product can then be loaded through the other opening. If necessary, further pressure can be applied to the side edges of the sleeve to open the other opening for loading of the product and installation of the second end cap. The above described manual operations may also be performed by machine.

Once the package has been loaded and closed, it would still be possible to adjust or rework the contents of the package by using the twist-off release mechanism described below to remove the releasable end cap without damaging the sleeve.

As mentioned above, it would also be possible to use releasable end caps at both openings of the sleeve, or non-releasable end caps at both openings. Also, in a container having one releasable end cap and one non-releasable end cap, it would be possible to use the releasable cap as the top cap or the bottom cap, as desired.

FIGS. 13A–D are cross section diagrams of an exemplary end cap 150 and sleeve end 170 illustrating the operation of a locking mechanism according to an aspect of the invention. The drawing of sleeve end 170 includes a broken line 172, which represents the perimeter of the sleeve opening.

As described above, the sleeve end 170 includes a pair of locking tabs 174. The locking tabs 174 extend upward from the sleeve 176. Prior to the installation of the end cap 150, the locking tabs 174 are folded into the sleeve opening, towards the inner surface of the sleeve 176. However, because of the resilience of the material used to fabricate the sleeve 176 and locking tabs 174, the locking tabs 174 have a tendency to unfold slightly. The slight unfolding of the locking tabs 174 has been exaggerated in FIGS. 13A–D for purposes of illustration. The unfolding of the locking tabs 174 is useful in ensuring a firm locking action.

The locking cap 150 includes a channel 152 at each side corresponding in position to the locking tabs 174. The channels 152 are not drawn to scale. As discussed above, in a non-releasable end cap, a single channel encircles the perimeter of the end cap. In a releasable end cap, separate channels are provided, corresponding in position to each of the locking tabs 174. However, in either type of end cap, the initial locking action is substantially similar.

The upper boundary of the channel 152 is defined by a rim 154 that, when the end cap 150 is seated in the sleeve end 170, overhangs the sleeve end 170 to prevent the end cap 150 from being further inserted into the sleeve end. The channel 152 further includes a ledge 156 that engages a locking edge of each of the locking tabs 174. Although the channel 152 is shown as having a rectangular profile, other channel profiles may also be used. For example, it may be desirable for the ledge to define a more acute angle, or for the channel to be deeper. The ledge face 158 is dimensioned and shaped to fit closely within the sleeve.

Figure 13A:
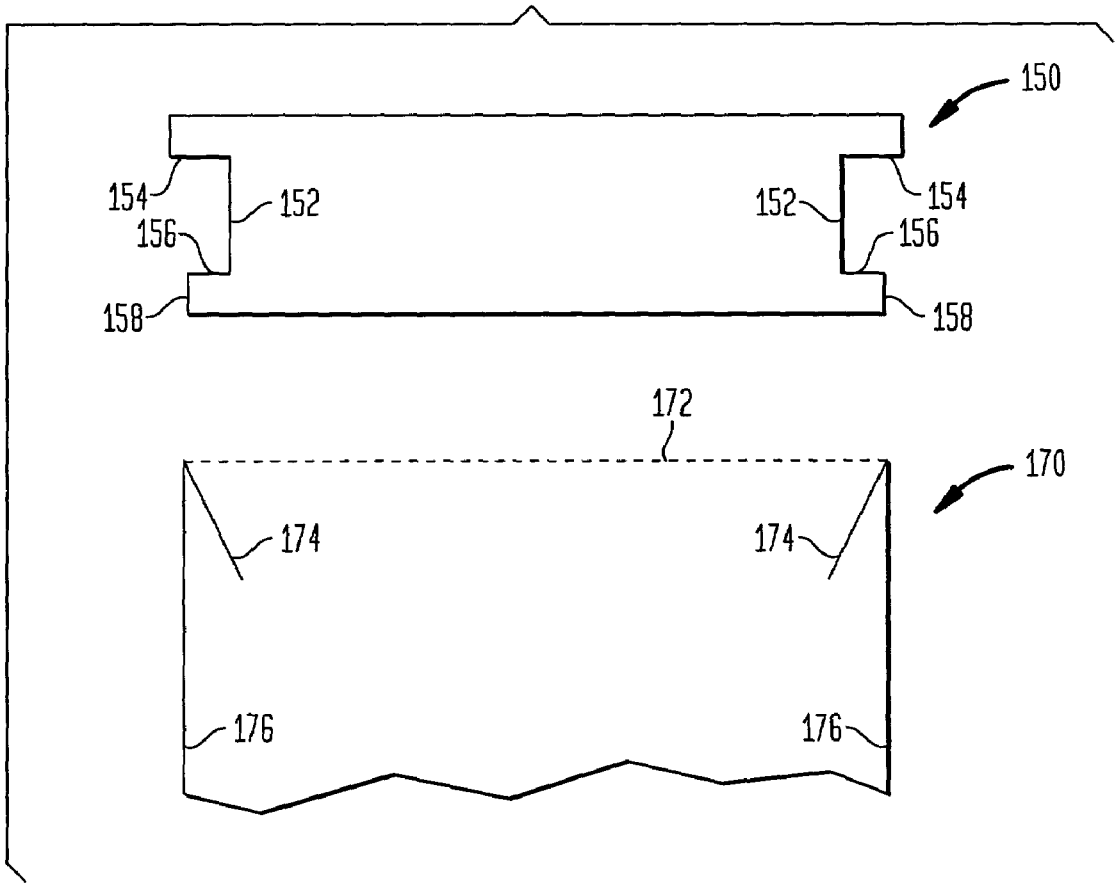
FIGS. 13A–D show a series of diagrams illustrating the operation of a locking mechanism according to an aspect of the invention.
Figure 13B:
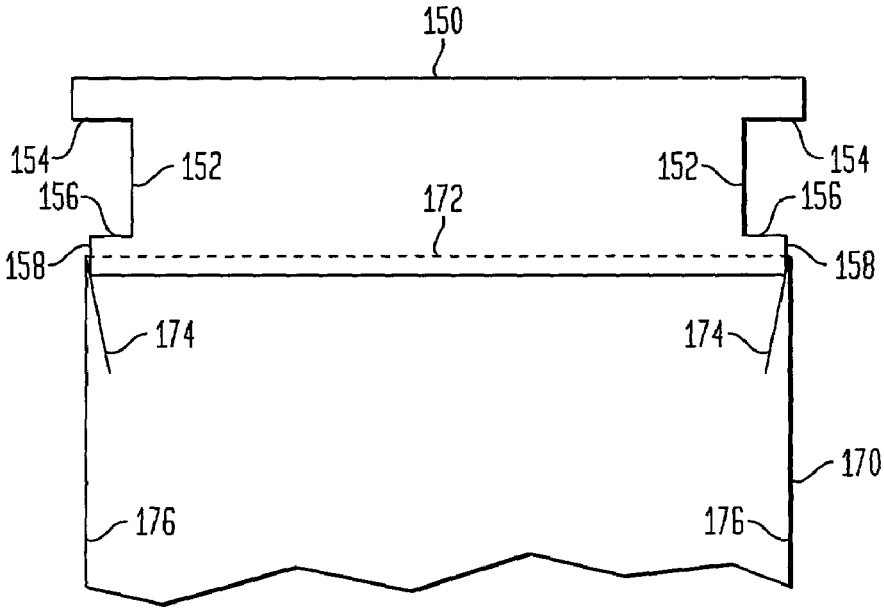
Figure 13C:
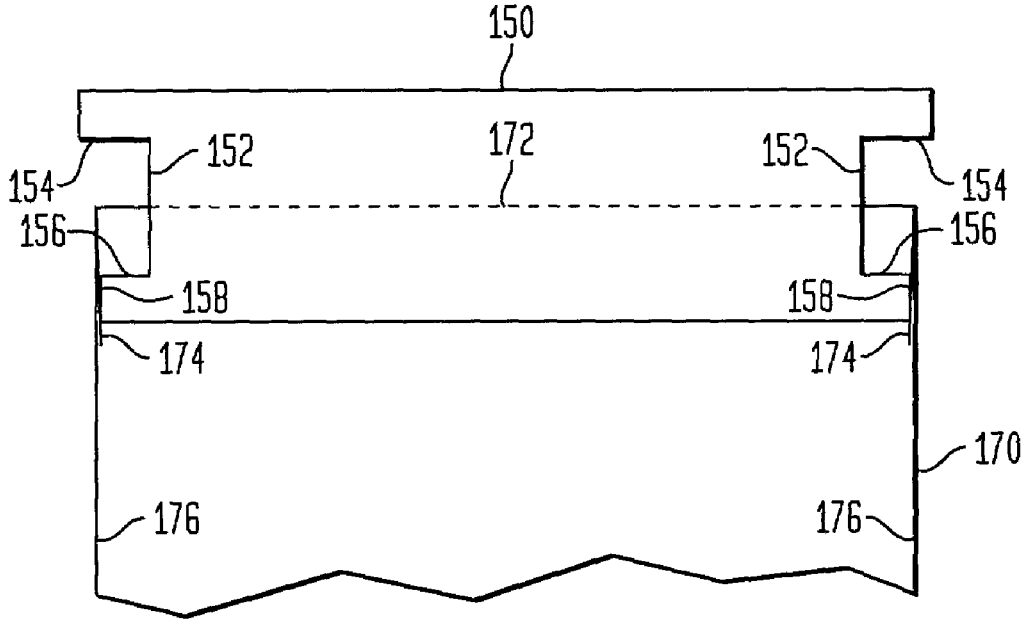
Figure 13D:
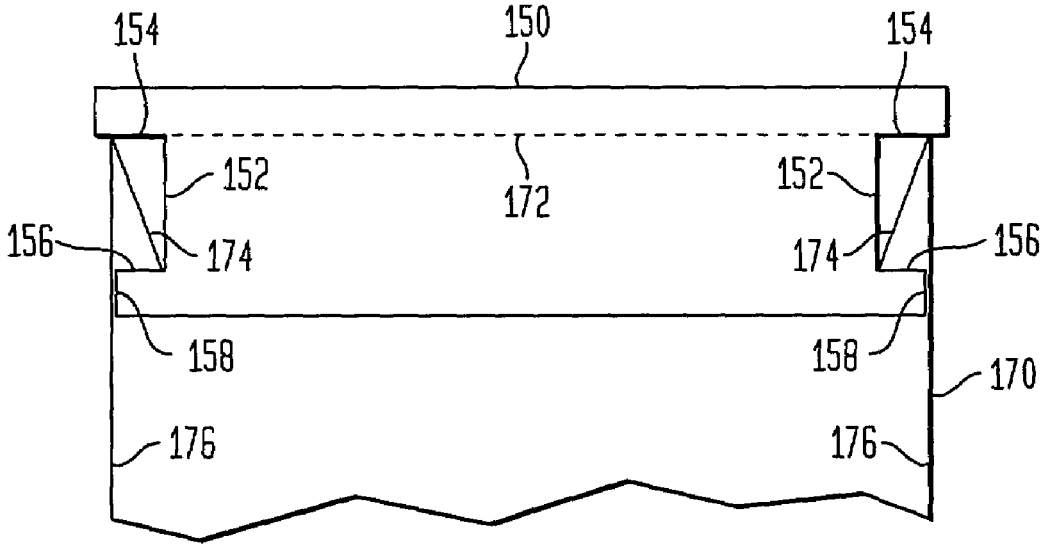

FIG. 13B shows the end cap 150 that has been partially inserted into the sleeve end 170. As shown in FIG. 13B, the bottom circumference of the end cap 150 urges the locking tabs 174 downward, towards the inner walls of the sleeve 176. In FIG. 13C, as the end cap 150 continues to be advanced downward, the locking tabs 174 are pressed against the inner walls of the sleeve 176. In FIG. 13D, when the end cap 150 reaches its final position, the locking tabs 174, because of their resiliency, tend to unfold slightly, causing the locking tabs 174 to open up into the channel 152. The slight unfolding of the locking tabs 174 causes the locking edges of the locking tabs 174 to engage the ledge surface 156, thereby preventing the end cap from being pulled upward out of the sleeve opening. Where the end caps have a convexly curved outer perimeter, the insertion of the end cap into the sleeve causes corresponding curves to form in the sleeve 176 and locking tabs 174. This curvature tends to increase the strength of the locking tabs 174.

Figure 14:
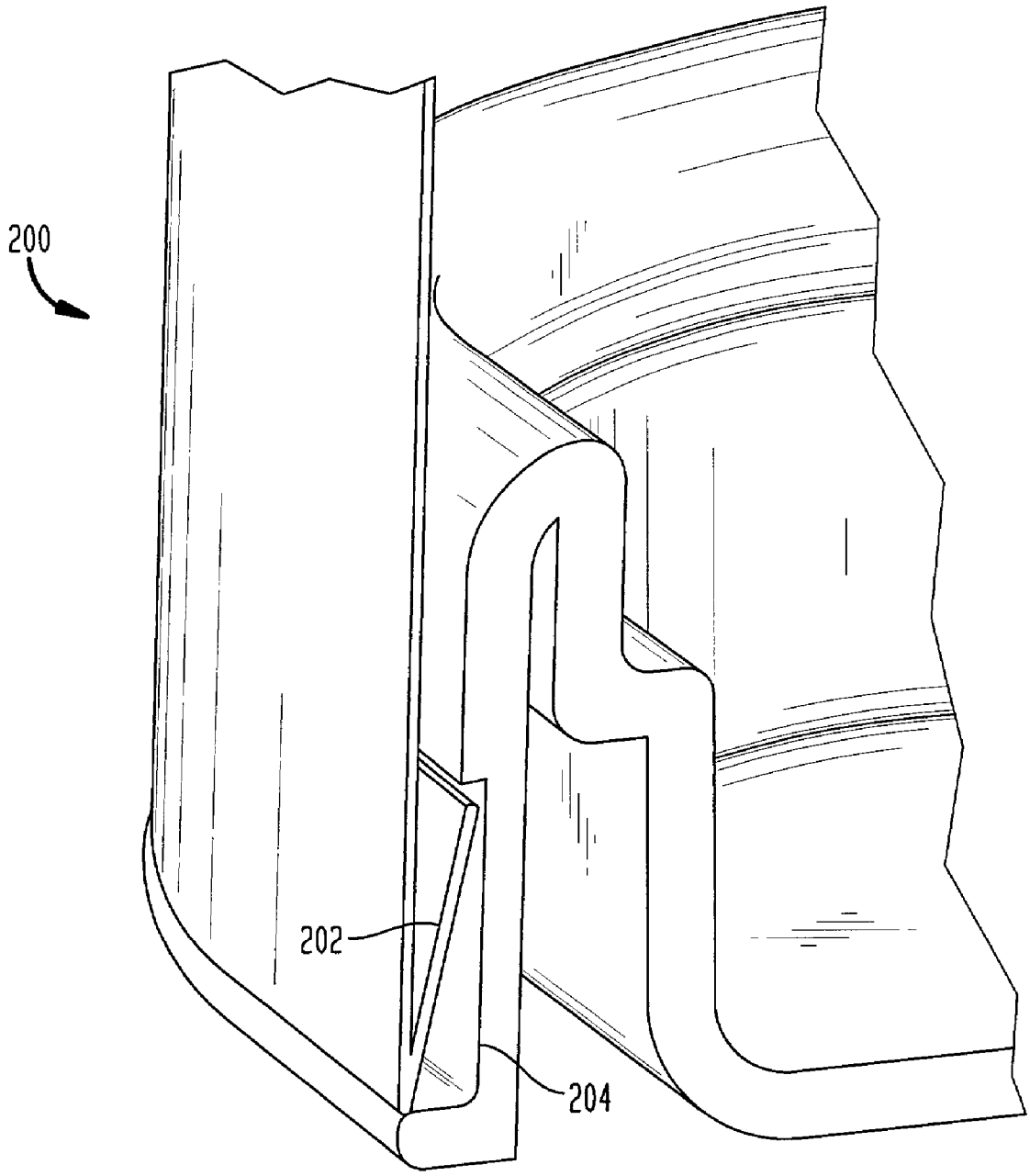
FIG. 14 shows a cutaway view of a sleeve and end cap illustrating the operation of a locking mechanism according to an aspect of the invention.
Figure 15:
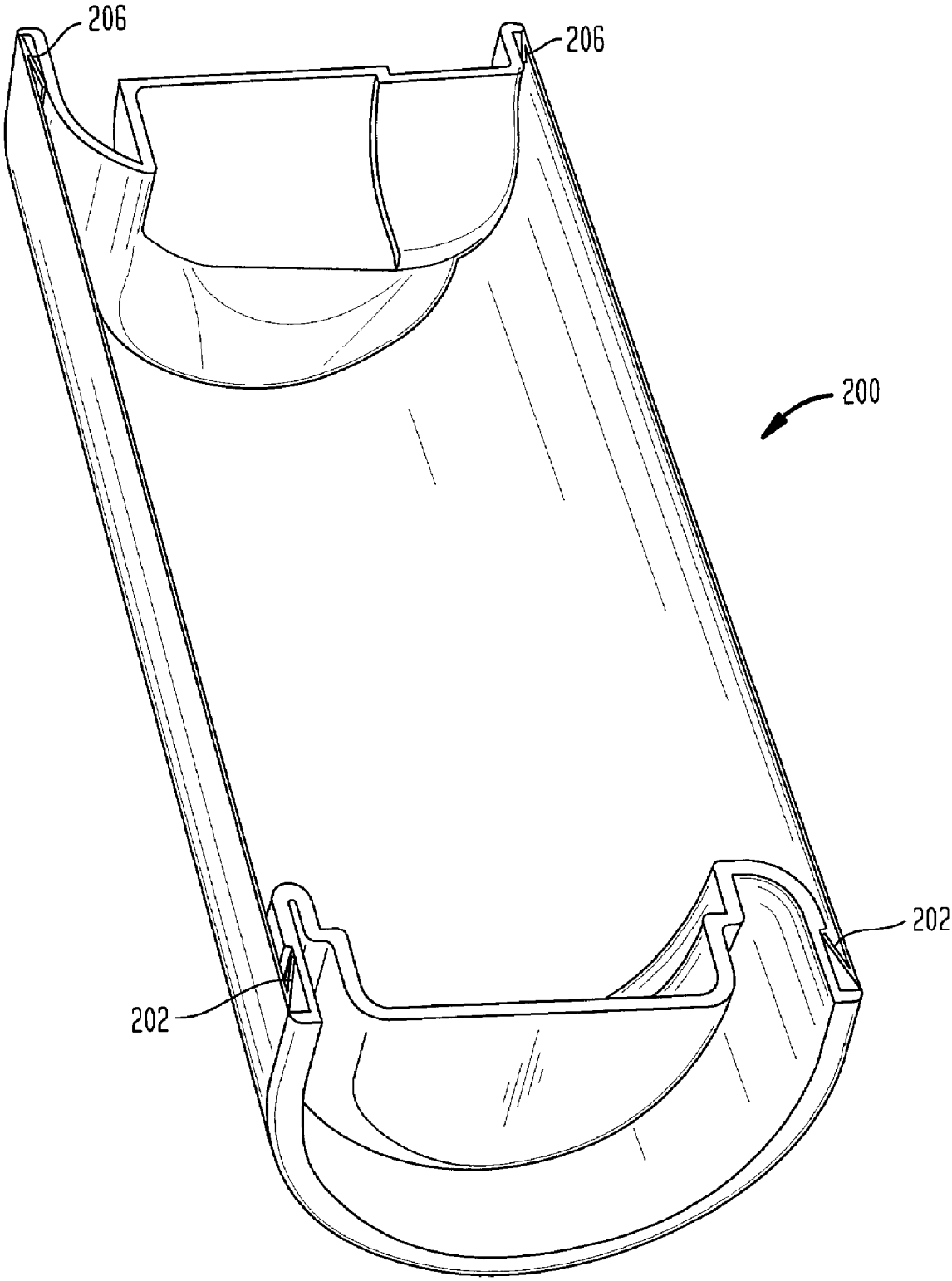
FIG. 15 shows a cutaway view of a sleeve and upper and lower end caps illustration the operation of a locking mechanism according to an aspect of the invention.

FIGS. 14 and 15 show cutaway views of a package 200 according to an aspect of the invention. FIG. 14 shows a close-up view of a portion of the package 200 illustrating a single locking tab 202 seated in a channel 204. FIG. 15 shows a cutaway of the whole package 200 illustrating a pair of lower locking tabs 202 and a pair of upper locking tabs 206.

FIGS. 16A–D and 17A–D illustrate the operation of a release mechanism 250 according to an aspect of the invention. FIG. 16A shows a diagram of a releasable locking tab 252 seated within a rectangular channel 254 in a finished package. For the purposes of discussion, an upper end cap is shown. As discussed above, the upper edge of the channel 254 is defined by the end cap rim, and the lower edge of the channel is defined by a ledge. The left and right edges of the channel are defined by surfaces 256 that are substantially continuous with the ledge face.

As described above, the releasable locking tab 252 has a trapezoidal shape. Thus, as the locking tab 252 is urged against a side edge 258 of the channel, it will be seen that an acute vertex 260 is presented to the side edge 258. The acute vertex 260 allows the locking tab 252 to ride up the side edge 258 of the channel 254 and onto surface 256, starting with the point of the vertex 260. The movement of the locking tab 252 onto surface 256 can be seen in FIGS. 17A–D.

Figure 18A:
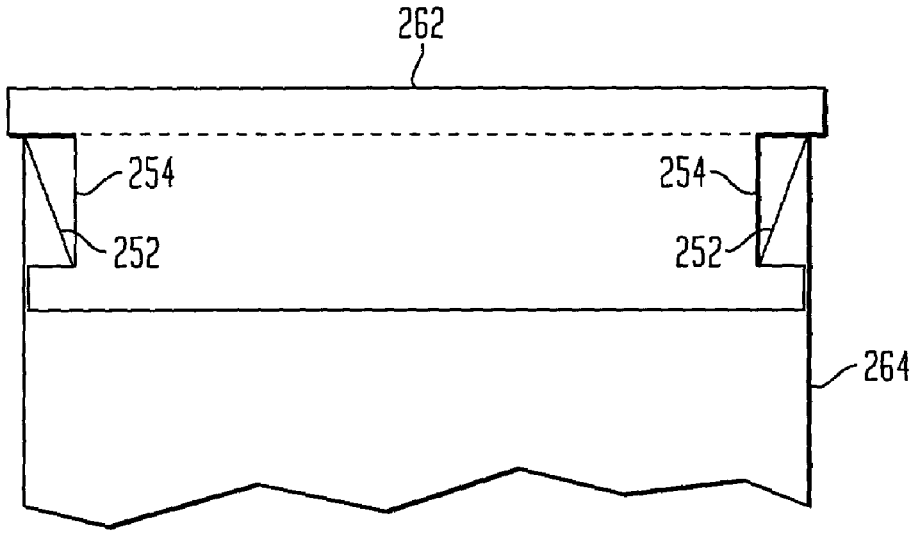
FIGS. 18A and 18B are diagrams illustrating the operation of the release mechanism illustrated in FIGS. 16A–D and 17A–D.
Figure 18B:
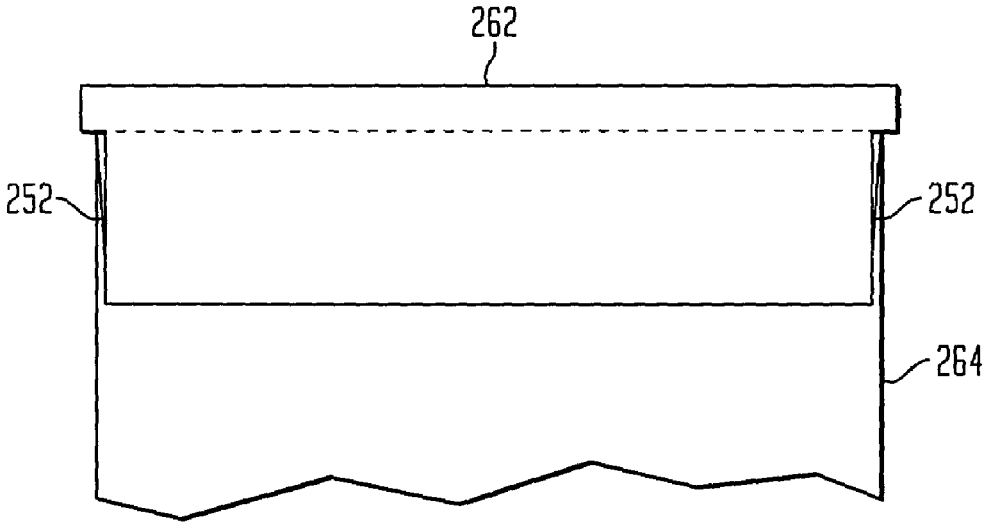
Figures 19A, 19B, 19C, 19D, 20A, 20B, 20C, 20D:
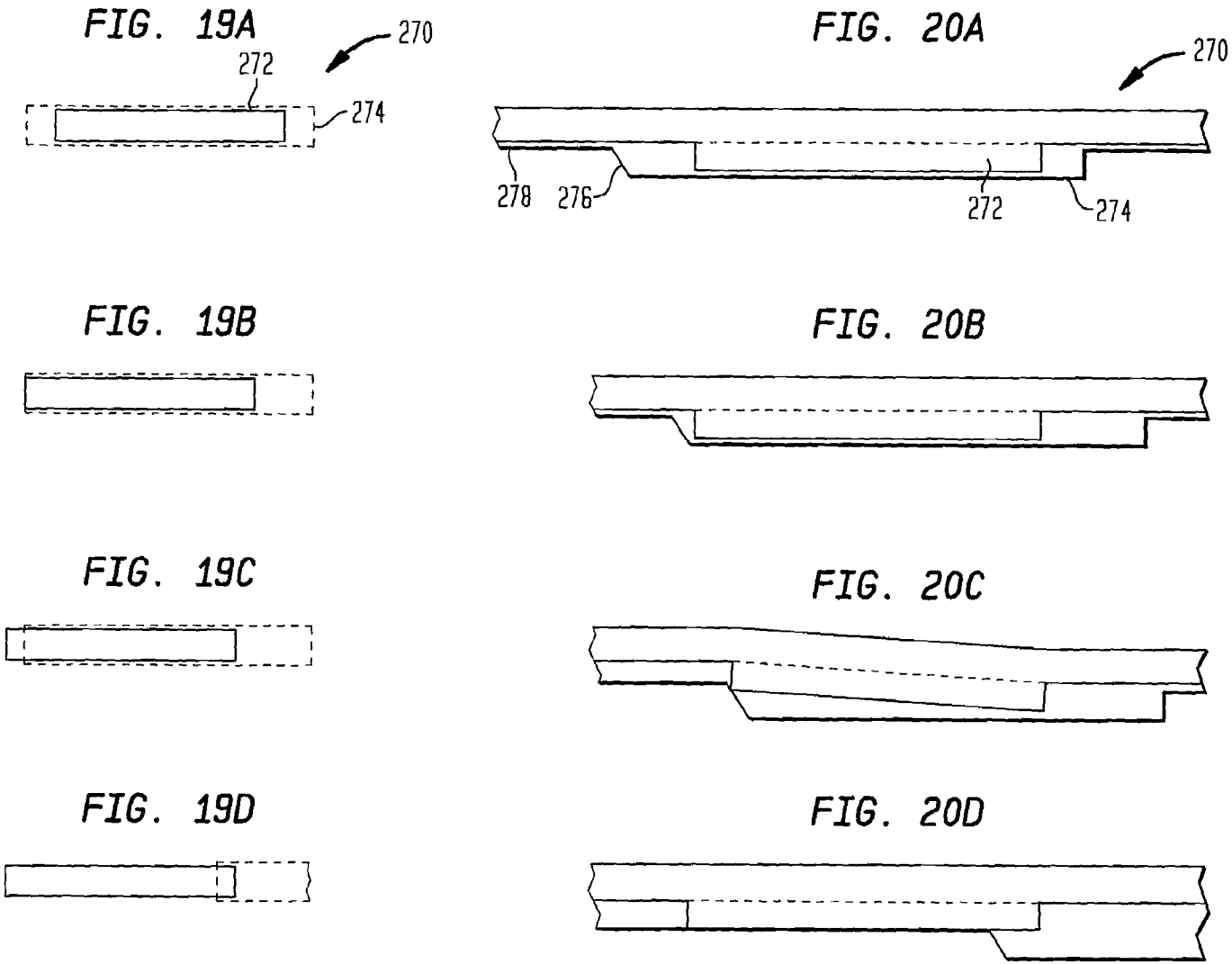
FIGS. 19A–D and 20A–D are a series of diagrams illustrating the operation of a release mechanism according to a further aspect of the invention.
Figure 21:
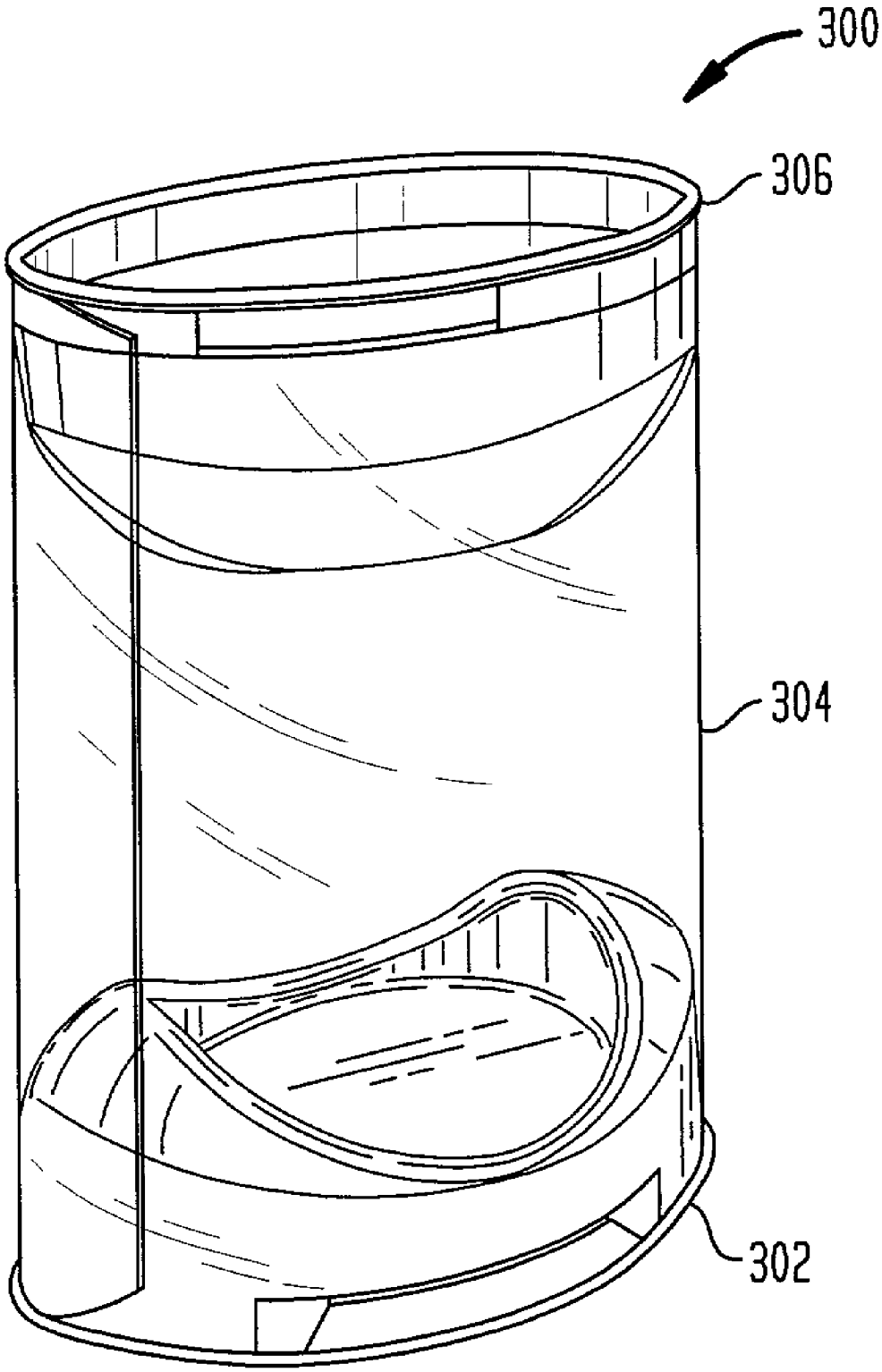
FIG. 21 shows a perspective view of a package according to another aspect of the invention.

Because the sleeve is flexible and resilient, the end cap can be freely twisted within the sleeve opening, even when the end cap does not have a circular perimeter. Twisting the end cap causes a movement of the channel relative to the tab. As described above, this movement causes the locking tab to ride up onto a surface next to the channel, causing the locking tab to become disengaged from the channel and ledge. The disengagement of the locking mechanism is illustrated in FIGS. 18A and 18B. In FIG. 18A, each locking tab 252 is seated in a channel 254. In FIG. 18B, after the locking cap 262 has been twisted, the locking tabs 252 are no longer in the channels 254. The end cap can now be removed. The twist angle required to disengage the end cap 262 from the sleeve 264 can be adjusted by adjusting the dimensions of the channels 254, the locking tabs 252, or both.

It would be possible to create a one-way release mechanism, in which the end cap can be released only by twisting it in one direction. The one-way release mechanism could be accomplished, for example, by using a locking tab having a first side with an acute vertex, and a second side with square vertices. It would be difficult, if not impossible, to twist the end cap off in the direction of the square vertices.

FIGS. 19A–D and FIG. 20A–D illustrate an alternative release mechanism. According to this aspect of the invention, a rectangular locking tab 272 may be used. As shown in FIGS. 20A–D, one side of the channel 274 is provided with a ramp 276 leading up to surface 278. When the end cap is twisted, the locking tab 272 rides up the ramp 276 and onto surface 278 to disengage the locking mechanism. In this example, only one ramp 276 is provided. Thus, the locking mechanism can only be released by twisting the end cap in the direction of the ramp 276. If desired, a second ramp can be added to the other side of the channel 274 to allow the locking mechanism to be released by twisting the end cap in either direction.

It should be noted that it would be possible to use other configurations of locking tabs and channels without departing from the spirit of the invention. For example, it would be possible to use more than two locking tabs per opening. Also, different shapes may be used for the end caps and the sleeve.

Figure 22:
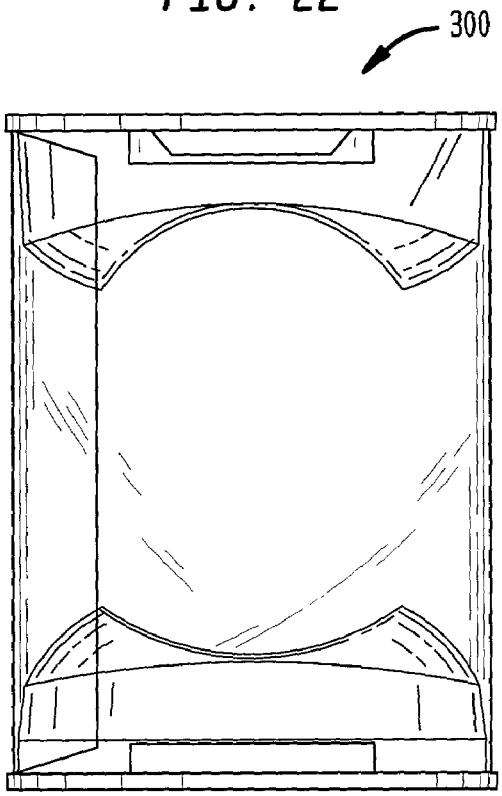
FIGS. 22 and 23 show front and rear views of the package shown in FIG. 21.
Figure 23:
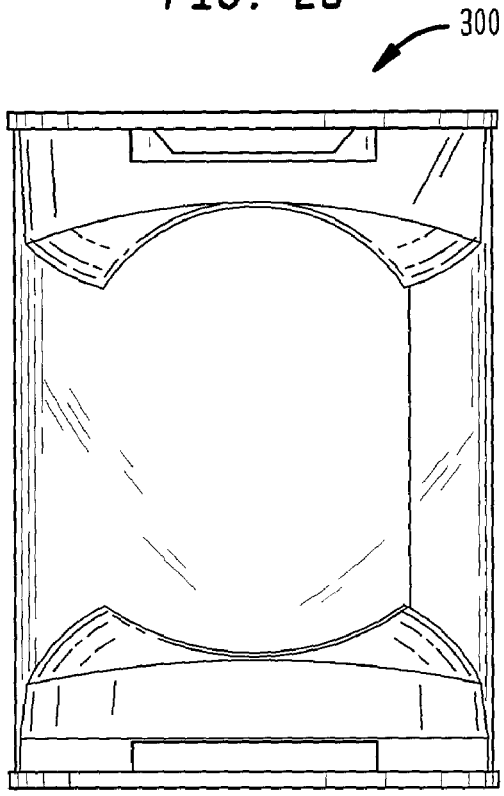
Figure 24:
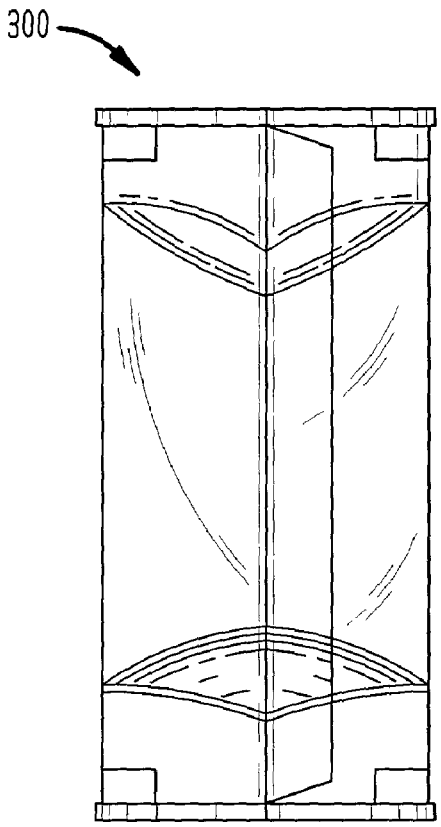
FIGS. 24 and 25 show left and rear side views of the package shown in FIG. 21.
Figure 25:
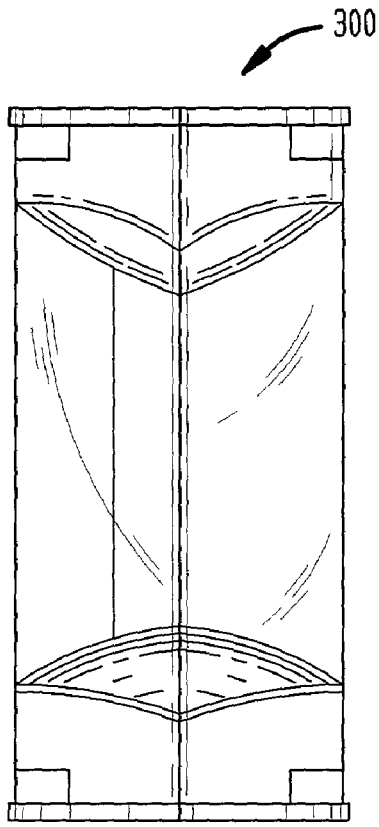
Figure 26:
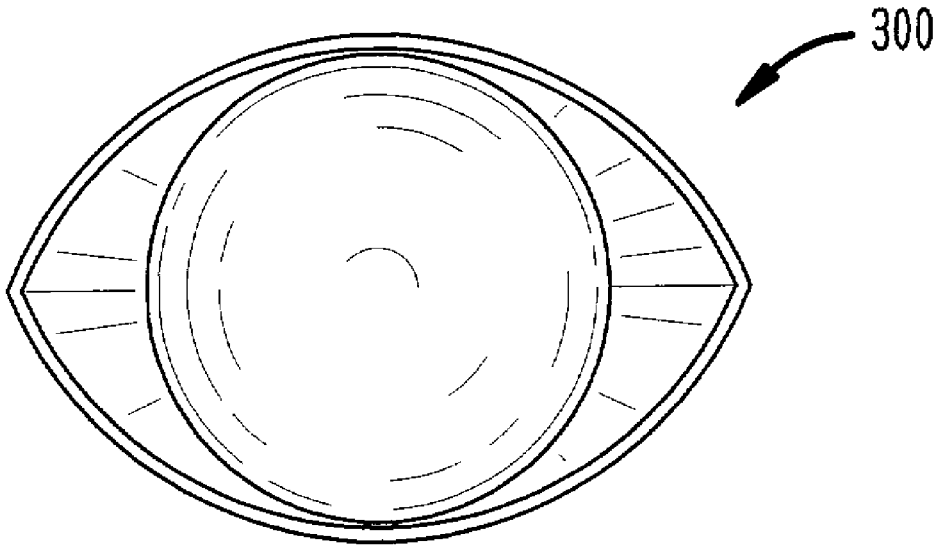
FIGS. 26 and 27 show top and bottom views of the package shown in FIG. 21.
Figure 27:
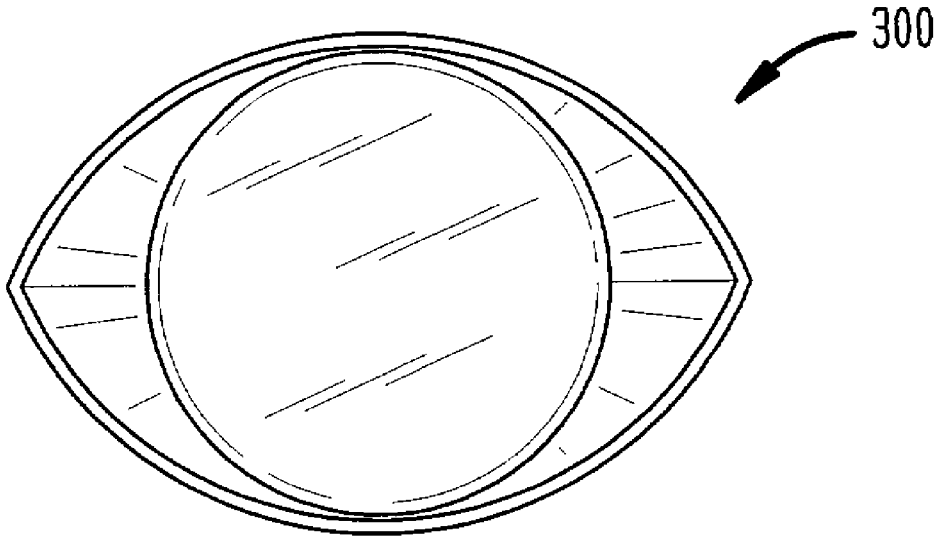

FIGS. 21 through 27 show a product package 300 according to another aspect of the invention. In this package 300, a releasable end cap 302 is provided at the bottom end of sleeve 304, and a non-releasable cap 306 is provided at the top of the sleeve. The end caps 302 and 306 have been shaped to receive a different product, such as a bottle containing lotion or fragrance. FIGS. 22 and 23 show front and rear views of the package 300. FIGS. 24 and 25 show left and right side views. FIGS. 26 and 27 show top and bottom views of the package 300.

Figure 28:
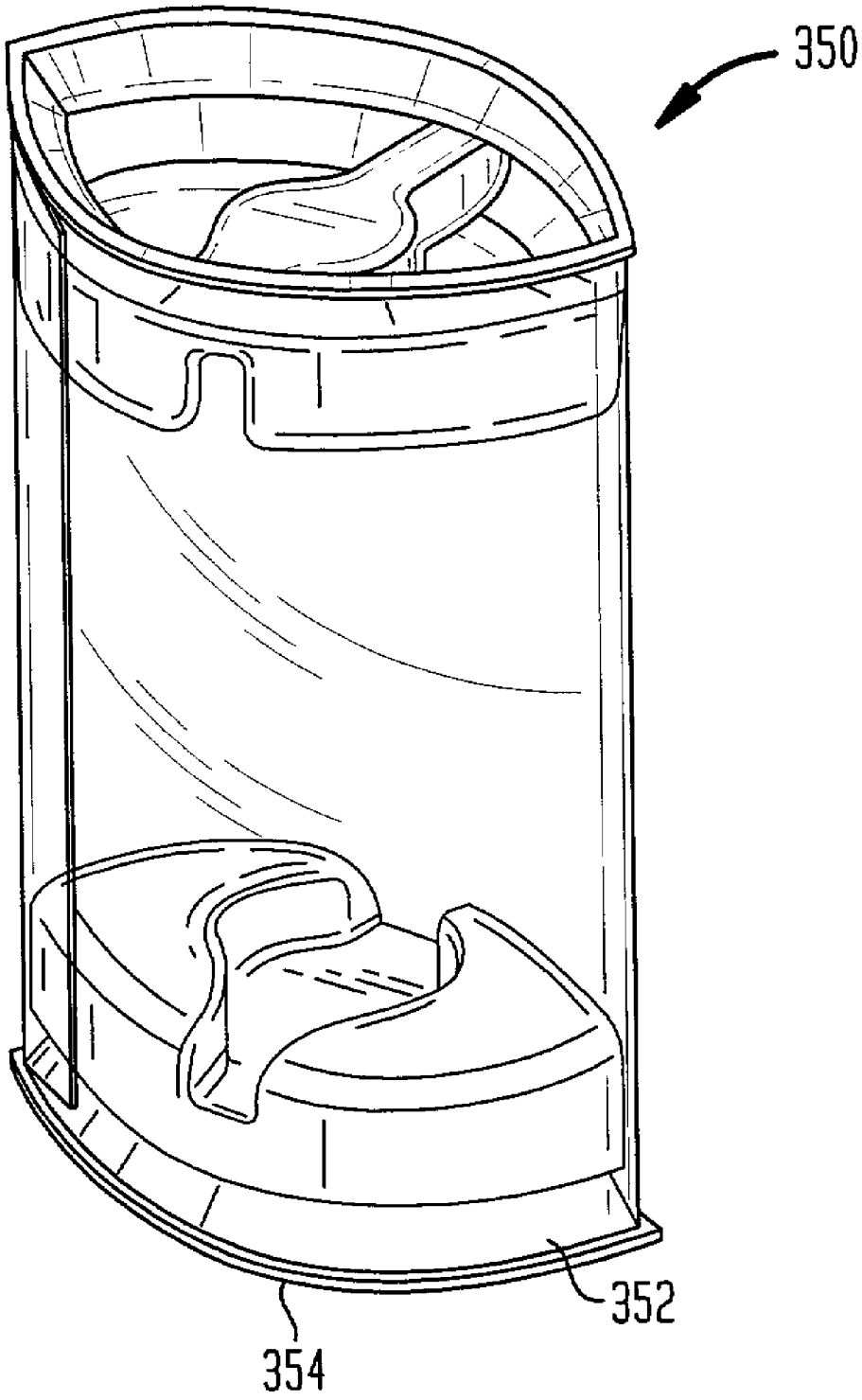
FIG. 28 shows a perspective view of a package according to another aspect of the invention.
Figure 29:
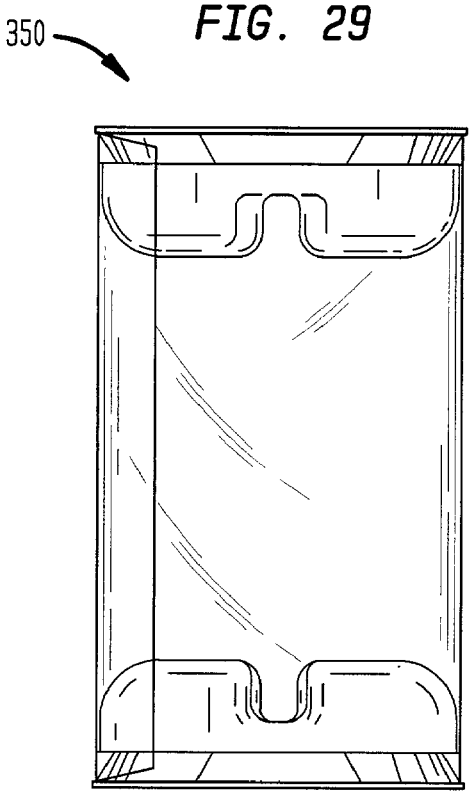
FIGS. 29 and 30 show front and rear views of the package shown in FIG. 28.
Figure 30:
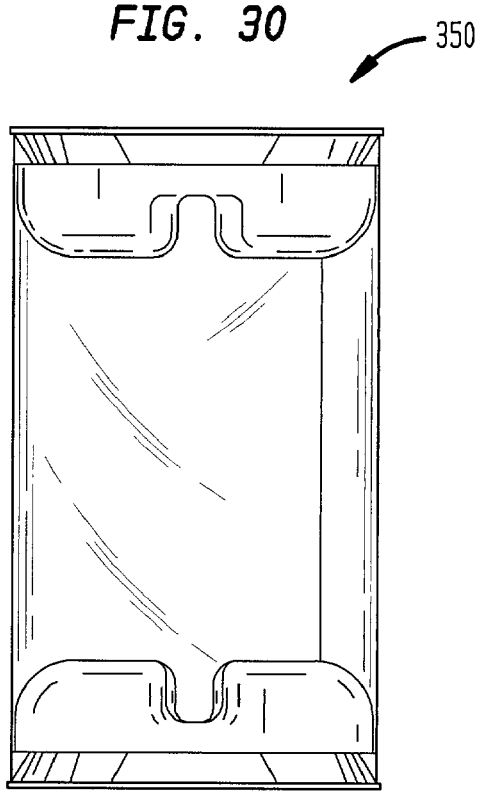
Figure 31:
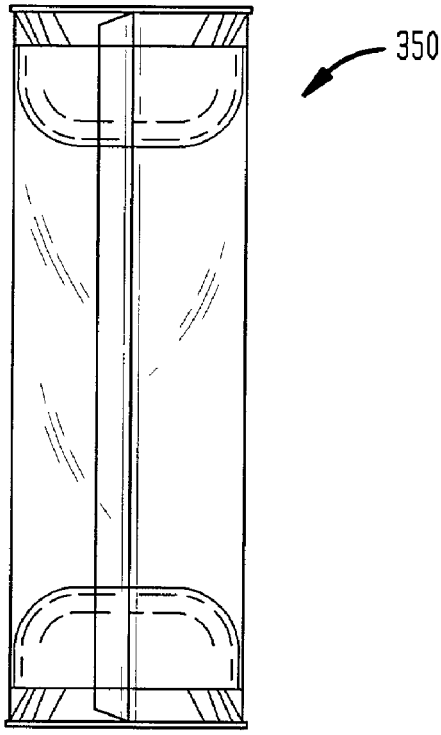
FIGS. 31 and 32 show left and right side views of the package shown in FIG. 28.
Figure 32:
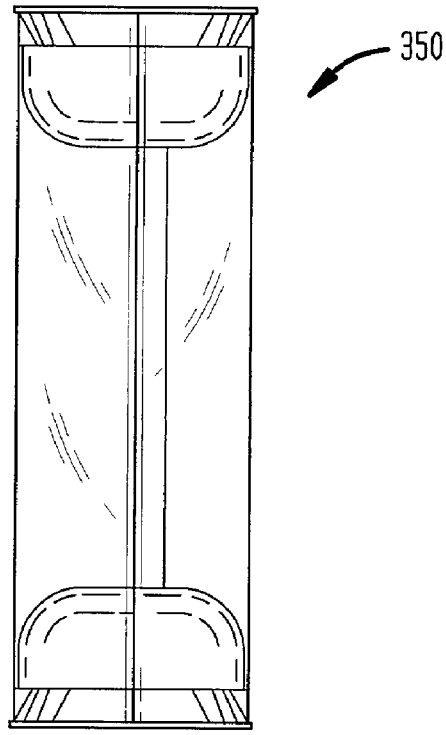
Figure 33:
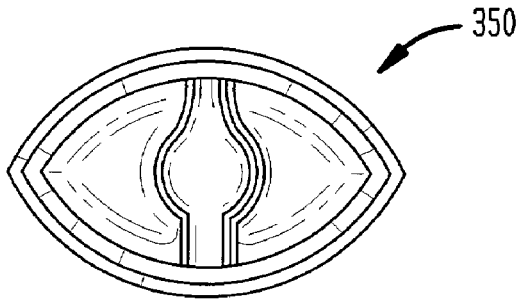
FIG. 33 shows a top view of the package shown in FIG. 28.

FIGS. 28 through 33 show another package 350 according to an aspect of the invention. FIG. 28 shows a perspective view of the package 350. As shown in FIG. 28, the channels 352 in the end caps 354 are not rectangular, but instead are angled. FIGS. 29 and 30 show front and rear views of the package. FIGS. 31 and 32 show left and right side views, and FIG. 20 shows a top view.

Figure 34:
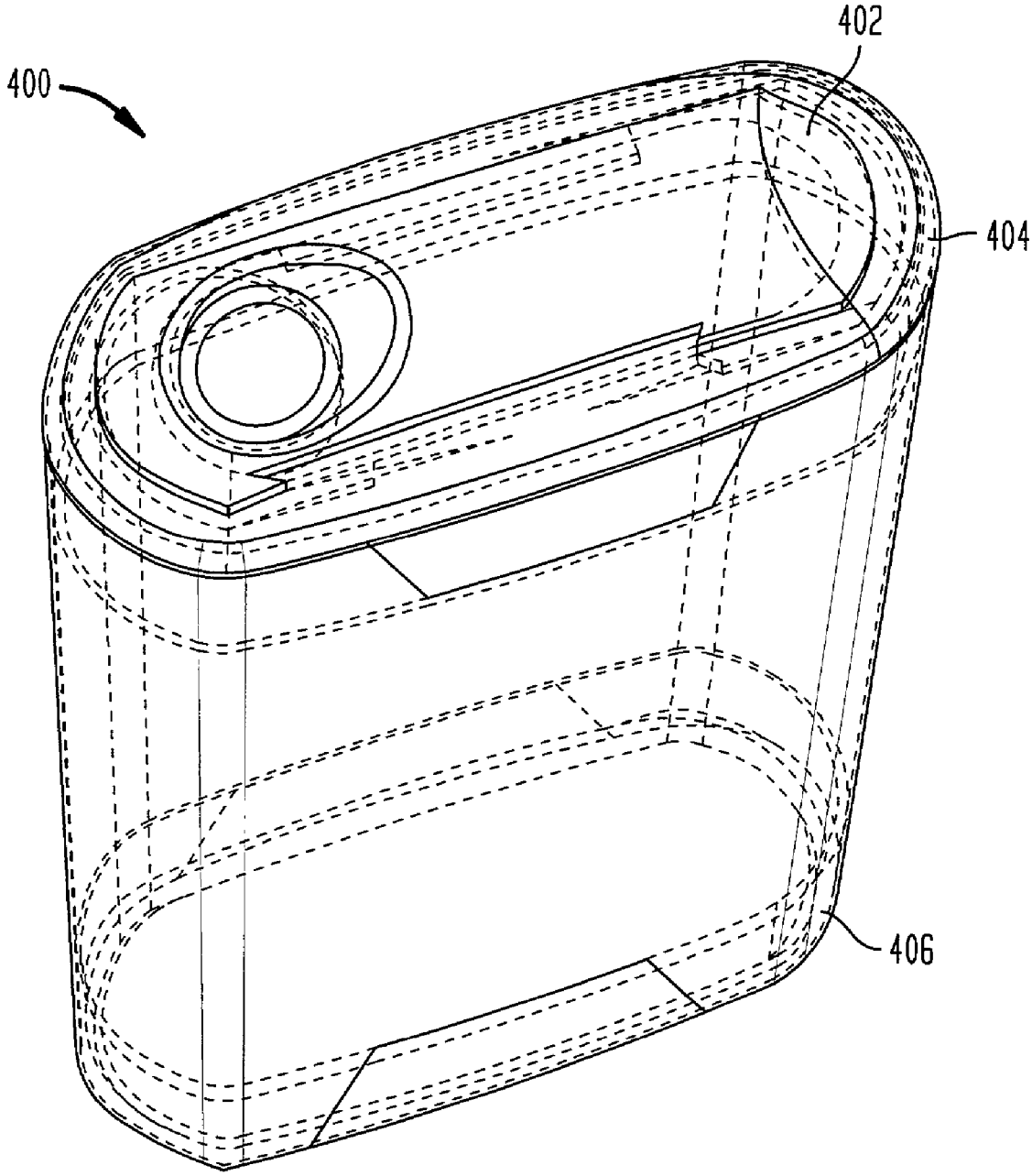
FIG. 34 shows a perspective view of a cigarette case according to another aspect of the invention.

FIG. 34 shows a perspective view of a cigarette case 400 fabricated according to an aspect of the invention. The cigarette case 400 is provided with a sliding top 402 to provide access to cigarettes contained in the case 400. The top and bottom caps 404 and 406 may be made releasable, if desired.

Figure 35:
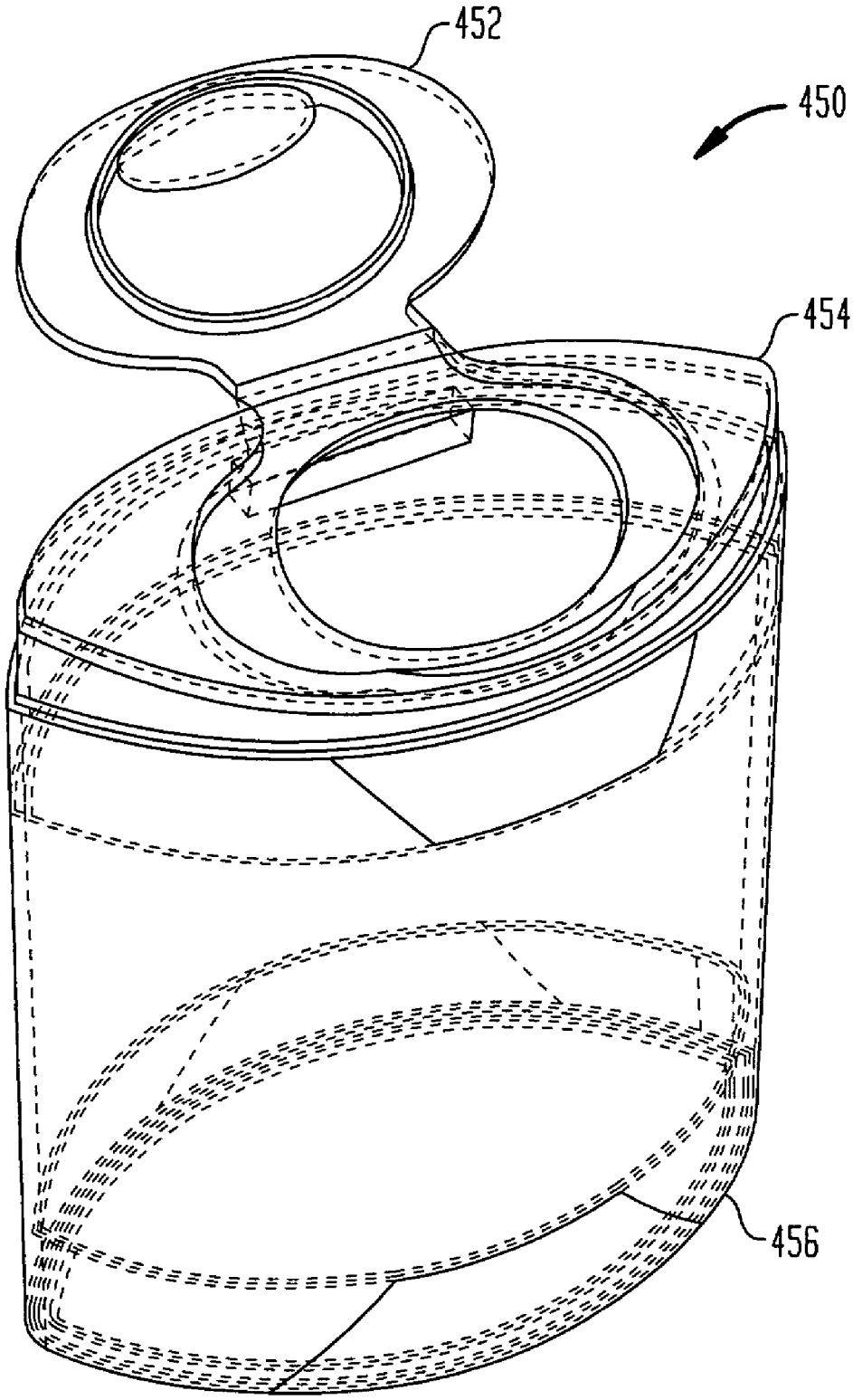
FIG. 35 shows a perspective view of another product package according to an aspect of the invention.

FIG. 35 shows a perspective view of another product package 450 according to an aspect of the invention. The package 450 includes a lid 452 that can be opened and re-closed. The package can be used to contain moist towelettes, or other retail item. The top and bottom caps 454 and 456 may be made releasable, if desired.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A package, comprising:

a sleeve including at least one end defining an opening, the sleeve including at least one pair of locking tabs extending therefrom, each locking tab including a locking edge, each locking tab being folded inwards into the opening; and a rigid end cap dimensioned to fit closely within the opening, the end cap including a rim that, when the end cap is inserted into the opening, engages the sleeve end and prevents the end cap from being inserted further into the opening, the end cap including a pair of channels for receiving the pair of locking tabs, each channel having a ledge that is dimensioned and angled to engage the locking edge of each locking tab to prevent the end cap from being removed from the sleeve opening, the sleeve and locking tabs having a strength and resilience that combines with the dimensioning and angling of the ledges to produce a firm locking action when the locking tabs are engaged by the ledges, each of the locking tabs and the channels being shaped such that the end cap is twistable to a position in which the locking tabs are clear of the ledges, thereby releasing the end cap from the sleeve.

2. The package of claim 1, wherein each of the locking tabs is trapezoidal and has an acute vertex that rides up a side edge of the locking tab's receiving channel when the end cap is twisted relative to the sleeve, such that the end cap is released from the sleeve.

3. The package of claim 1, wherein each of the channels has at least one ramped side edge, such that when the end cap is twisted relative to the sleeve, each locking tab rides up the ramped side edge of the locking tab's receiving channel, such that the end cap is released from the sleeve.

4. The package of claim 1, wherein the sleeve includes a second end defining a second opening, and wherein the package further comprises:

a second pair of locking tabs extending from the second end and folded inward into the second opening, each of the second pair of locking tabs having a locking edge;

a second end cap dimensioned to fit closely within the second opening, the second end cap including a rim that, when the second end cap is inserted into the second opening, engages the second sleeve end and prevents the second end cap from being inserted further into the second opening, the second end cap including a channel for receiving the second pair of locking tabs, the channel having a ledge that engages the locking edge of each of the second pair of locking tabs to prevent the second end cap from being removed from the second sleeve opening.

5. The package of claim 4, wherein the end caps include cavities shaped to receive an end of a product contained in the package.

6. The package of claim 1, wherein the end cap includes a cavity shaped to receive an end of a product contained in the package.

* * * * *